US008667797B2

(12) United States Patent
Woodland et al.

(10) Patent No.: US 8,667,797 B2
(45) Date of Patent: Mar. 11, 2014

(54) ORGANIC RANKINE CYCLE WITH FLOODED EXPANSION AND INTERNAL REGENERATION

(75) Inventors: Brandon Jay Woodland, West Lafayette, IN (US); James E. Braun, West Lafayette, IN (US); Eckhard A. Groll, West Lafayette, IN (US); W. Travis Horton, West Lafayette, IN (US)

(73) Assignee: Purdue Research Foundation, West Lafayette, IN (US)

( * ) Notice: Subject to any disclaimer, the term of this patent is extended or adjusted under 35 U.S.C. 154(b) by 166 days.

(21) Appl. No.: 13/180,426

(22) Filed: Jul. 11, 2011

(65) Prior Publication Data

US 2012/0006022 A1 Jan. 12, 2012

Related U.S. Application Data

(60) Provisional application No. 61/362,736, filed on Jul. 9, 2010.

(51) Int. Cl.

| | |
|---|---|
| ***F01K 25/06*** | (2006.01) |
| ***F01K 25/08*** | (2006.01) |
| ***F01K 25/00*** | (2006.01) |
| ***F03G 7/00*** | (2006.01) |

(52) U.S. Cl.
USPC ..... 60/649; 60/651; 60/671; 60/641.2

(58) Field of Classification Search
USPC ..... 60/645–684, 641.2–641.5
See application file for complete search history.

(56) References Cited

U.S. PATENT DOCUMENTS

| | | | | |
|---|---|---|---|---|
| 3,274,769 | A * | 9/1966 | Reynolds | 60/641.2 |
| 3,702,534 | A * | 11/1972 | Bechtold | 60/651 |
| 5,832,728 | A * | 11/1998 | Buck | 60/407 |
| 7,284,363 | B2 * | 10/2007 | Kung et al. | 60/39.182 |
| 7,401,475 | B2 | 7/2008 | Hugenroth et al. | |
| 7,647,790 | B2 | 1/2010 | Ignatiev et al. | |
| 2009/0205336 | A1 * | 8/2009 | Blonn et al. | 60/649 |

OTHER PUBLICATIONS

Woodland, et al. "Performance Benefits for Organic Rankine Cycles with Flooded Expansion." Jun. 2, 2010, Purdue University E-Pubs. p. 1-9.*

* cited by examiner

*Primary Examiner* — Thomas Denion
*Assistant Examiner* — Brian Inacay
(74) *Attorney, Agent, or Firm* — Hartman Global IP Law; Gary M. Hartman; Domenica N. S. Hartman

(57) ABSTRACT

A heat engine system configured to extract thermal energy from a heat source, convert a first portion of the thermal energy to work using an expansion device, and reject a second portion of the thermal energy to a heat sink. The system utilizes a second fluid to inhibit a temperature drop of the first fluid within the expansion device.

17 Claims, 2 Drawing Sheets

ORGANIC RANKINE CYCLE WITH FLOODED EXPANSION AND INTERNAL REGENERATION

CROSS REFERENCE TO RELATED APPLICATIONS

This application claims the benefit of U.S. Provisional Application No. 61/362,736, filed Jul. 9, 2010, the contents of which are incorporated herein by reference.

BACKGROUND OF THE INVENTION

The present invention generally relates to the field of thermal sciences, and more particularly to heat engines for waste heat recovery.

A heat engine is a device that takes energy from a heat source and converts some of the heat energy into work while rejecting the remaining heat energy to a heat sink. An example of a heat engine is the Rankine cycle-type heat engine represented in FIG. 1.

The thermal efficiency of a heat engine is highly dependent on the difference in temperature between the heat source and the heat sink. When this temperature difference is small, a heat engine's efficiency is low. Because the heat sink temperature is typically fixed by the temperature of the environment, it is desirable to use a heat source with as high of a temperature as possible. However, in waste heat recovery applications, the heat source temperature is also fixed by the temperature of the waste heat. This fixes the thermal efficiencies of waste heat recovery machines to values which are typically small. An economical means to improve the efficiency of waste heat recovery machines is desirable because the initial investment for a machine with low efficiency should not be very large.

BRIEF DESCRIPTION OF THE INVENTION

The present invention provides a heat engine system and method for extracting thermal energy from a heat source.

According to a first aspect of the invention, the heat engine system includes a first pump operable to pump a first fluid from an inlet to an outlet thereof, and a regenerator having first and second inlets and first and second outlets. The first inlet of the regenerator is fluidically coupled to the outlet of the first pump and to the first outlet of the regenerator. The second inlet of the regenerator is fluidically coupled to the second outlet of the regenerator. A heat source is fluidically coupled to the first outlet of the regenerator and in thermal communication the first fluid after exiting the regenerator through the first outlet thereof. A mixer has an outlet and first and second inlets, with the first inlet adapted to receive the first fluid from the heat source. A second pump is operable to pump a second fluid from an inlet to an outlet thereof. The outlet of the second pump is fluidically coupled to the heat source to deliver the second fluid into thermal communication with the heat source. The outlet of the second pump is further fluidically coupled to the second inlet of the mixer so that the first and second fluids are mixed and brought into thermal communication by the mixer as a fluid mixture after the first and second fluids are in thermal communication with the heat source. An expansion device is provided having an inlet fluidically coupled to the outlet of the mixer, and an outlet through which the fluid mixture exits the expansion device. A separator has an inlet that receives the fluid mixture from the outlet of the expansion device. The separator is operable to separate the first fluid from the second fluid and cause the first and second fluids to exit the separator through first and second outlets, respectively, thereof. The first outlet of the separator is fluidically coupled with the second inlet of the regenerator and the second outlet of the separator is fluidically coupled with the inlet of the second pump. Finally, a heat sink is fluidically coupled to the second outlet of the regenerator and in thermal communication the first fluid after exiting the regenerator through the second outlet thereof. The inlet of the first pump is fluidically coupled to the heat sink to receive the first fluid from the heat sink.

According to a second aspect of the invention, a method is provided that uses the heat engine system described above to extract thermal energy from the heat source, convert a first portion of the thermal energy to work using the expansion device, and reject a second portion of the thermal energy to the heat sink. The method includes using the second fluid to inhibit a temperature drop of the first fluid within the expansion device.

A technical effect of the invention is the ability of the heat engine system to operate with an enhanced Rankine thermodynamic cycle. The enhancement employed includes modifications to a traditional Rankine cycle. One modification is the introduction of a secondary liquid loop containing the second fluid, which remains subcooled at all cycle temperatures and pressures. The second fluid is mixed with the first fluid before the expansion process takes place. The second fluid is preferably chosen to have a higher heat capacity than the first fluid, so that the second fluid is able to minimize the temperature drop of the first fluid during expansion. Another modification of the traditional Rankine cycle takes advantage of a higher temperature of the first fluid at the separator exit resulting from the first modification. Following expansion, the first fluid can be employed to preheat the first fluid as it flows from the first pump to the heat source. This aspect of the invention is able to reduce the heat input to the system and increase its efficiency. As such, the system is capable of providing an economical technique to extract more work from a heat source, for example, a waste heat stream or geothermal temperature source.

Other aspects and advantages of this invention will be better appreciated from the following detailed description.

DETAILED DESCRIPTION OF THE INVENTION

Figure 1:
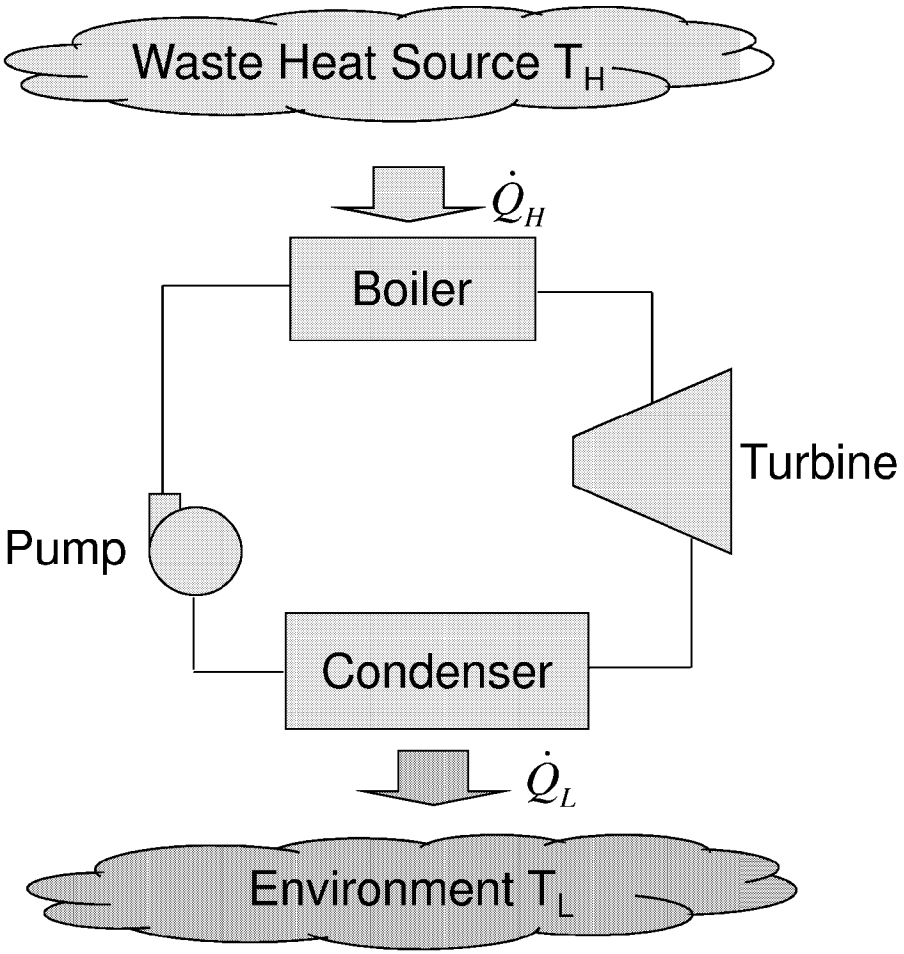
FIG. 1 (Prior Art)
FIG. 1 is a schematic of a conventional heat engine that utilizes a conventional Rankine cycle in accordance with the prior art.

The invention employs an economical enhancement to the efficiency of a Rankine cycle-type heat engine for waste heat recovery. It is known in the art that an internal heat exchanger or regenerator (hereinafter, regenerator) can improve the efficiency of a thermodynamic cycle. However, in a Rankine cycle, the working fluid is often expanded to a temperature which is too low for effective regeneration. In order to make use of the regeneration concept in a Rankine cycle, the present invention provides a Rankine cycle-type heat engine modified to introduce, along with the working fluid, a second liquid into an expansion device. This liquid, referred to below as a flooding media) can act as a buffer against the temperature drop which normally occurs in the working fluid during the expansion process. With the working fluid now exiting the expansion device at a higher temperature, an internal heat exchanger can be employed to increase the efficiency of the cycle.

The liquid-flooded expansion process described is possible using a variety of expansion devices. For example, scroll and screw-type expansion devices are particularly tolerant of liquid in the expansion process. The concept of flooded expansion (and compression) has been employed in other thermodynamic cycles. For example, U.S. Pat. No. 7,401,475 discloses the concept of both flooded compression and expansion in an Ericsson cycle, and U.S. Pat. No. 7,647,790 discloses the use of flooded compression via injection in a vapor compression cycle. However, the application of flooded expansion to a Rankine cycle is believed to be unknown.

According to a further aspect of the invention, a practical method is provided for approximating an isothermal expansion process for a Rankine cycle heat engine. The Rankine cycle is known as comprising four thermodynamic processes. In an ideal Rankine cycle, the processes are constant entropy pumping of a saturated liquid to a relative high pressure, constant pressure heat addition until the working fluid is at least fully evaporated, constant entropy expansion to a relative low pressure, through which process work is extracted from the energy in the working fluid, and constant pressure heat rejection until the working fluid is fully condensed.

As noted above, a first significant difference between the present invention and traditional Rankine cycle is that the working fluid is mixed with a liquid flooding media. The flooding media is chosen to have a relatively higher heat capacity than the working fluid. The working fluid and the flooding media are expanded together with an expansion device, with the result that the working fluid exits the expansion device at a significantly higher temperature than in an otherwise equivalent expansion process performed in a traditional Rankine cycle. With the working fluid at a sufficiently high temperature, it may be passed through an internal heat regenerator to preheat the working fluid after the pump exit and before it is heated by the heat source. This reduces the required heat input to the working fluid and increases the thermal efficiency of the cycle.

Figure 2:
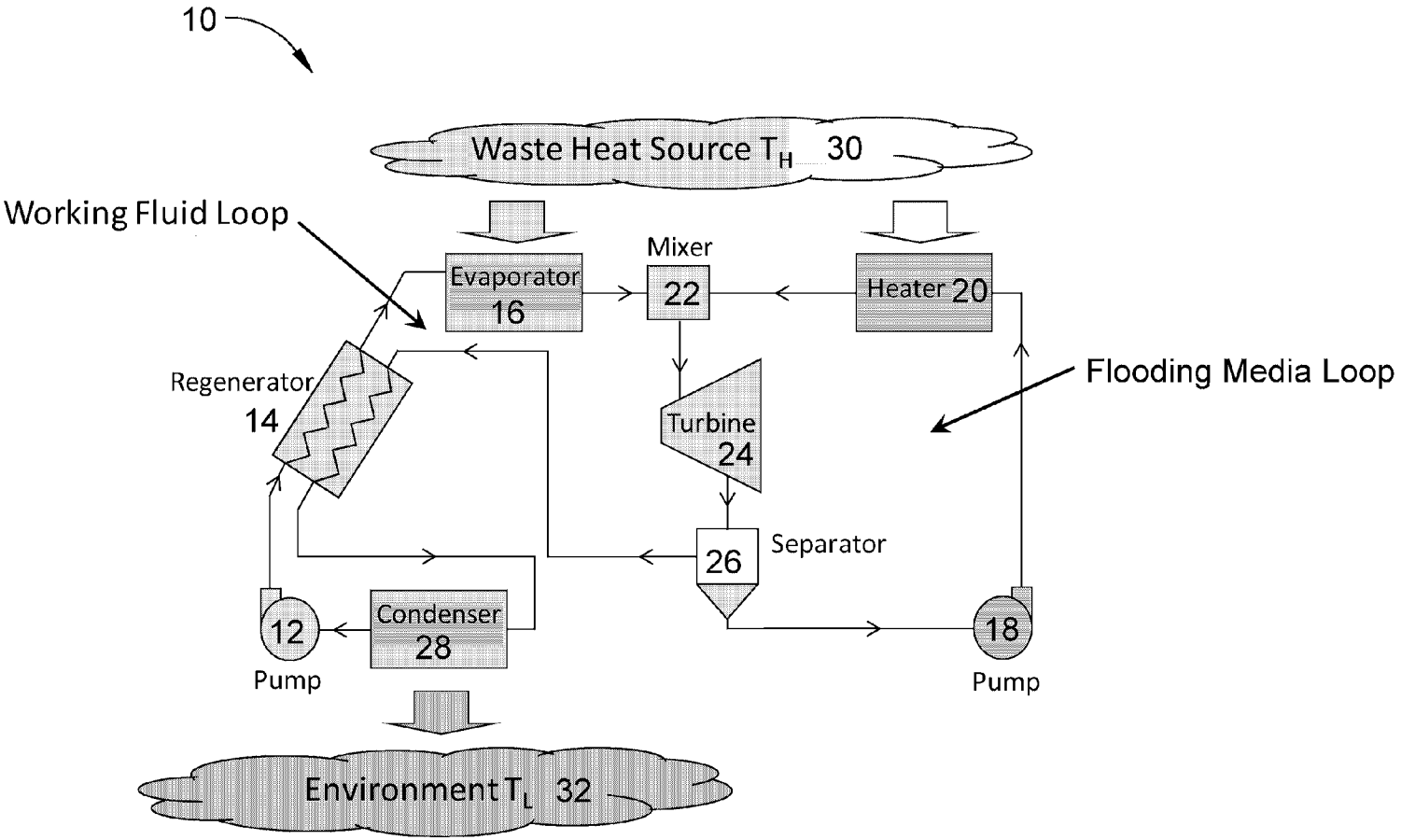
FIG. 2 is a schematic of a heat engine that utilizes a modified Rankine cycle with flooded expansion in accordance with an embodiment of this invention.

For purposes of further describing the invention, FIG. 2 schematically represents a Rankine cycle-type heat engine for waste heat recovery, in which the heat engine has been modified in incorporate certain features of the present invention. The system represented in FIG. 2 comprises the following components: a working fluid pump 12, an internal regenerator (heat exchanger) 14, an evaporator 16, a flooding media pump 18, a liquid heater 20, a mixer 22 for mixing the working fluid and flooding media, an expansion device 24, a separator 26 for separating the working fluid and flooding liquid, and a condenser 28. Particularly notable working fluids for use with the invention include the hydrocarbon refrigerants R600a, n-Pentane and R245fa, though the use of other types of refrigerants is also foreseeable, including but not limited to R245fa and R717. As previously noted, the flooding media is selected to have a higher heat capacity than the working fluid used. Notable fluids for use as the flooding media include water and oils, a notable example of the latter being refrigeration oils, a commercial example of which is ZEROL 60, an alkylbenzene refrigeration oil available from Nu-Calgon.

In the example of FIG. 2, the working fluid enters the pump 12 in a liquid state and at a low pressure. The pump 12 brings the working fluid to a relatively higher pressure and causes the fluid to pass through the regenerator 14, where it is preheated by a quantity of the working fluid entering the regenerator 14 at a higher temperature (explained below) from the separator 26. The heated working fluid then passes through the evaporator 16, where it is further heated by an external heat source 30 up to a maximum temperature ($T_H$) approaching that of the temperature of the heat source 30. At the same time, the flooding media enters the pump 18 in a liquid state and at a low pressure, and the pump 18 brings the flooding media to a pressure approximately equal to the pressure of the working fluid that exited the pump 12. The flooding media is then heated by the heater 20 to a temperature approximately equal to the temperature of the working fluid that exited the evaporator 15. At this point, both fluid streams are shown as being combined in the mixer 22 before the resulting liquid mixture is expanded through the expansion device 24, identified in FIG. 2 as a turbine. Because of the close thermal contact between the working fluid and flooding media within the liquid mixture, the flooding media (which does not significantly drop in temperature during expansion) exchanges heat with the working fluid (which would otherwise tend to drop in temperature as it expands). As a result, the working fluid exits the expansion device 24 with a much higher temperature than that with which it would have exited through a normal expansion process in the absence of the flooding media.

The liquid mixture containing the working fluid and flooding media then enters the separator 26, where the working fluid and flooding media are separated into different streams again. The stream of flooding media is returned by the separator 26 to the pump 18, completing the cycle of the flooding media within the engine 10. The stream of working fluid is routed by the separator 26 to the regenerator 14, where its relatively high elevated temperature is used to preheat the working fluid entering the regenerator 14 from the pump 12. The working fluid then passes through the condenser 28 associated with an external heat sink 32 at a lower temperature ($T_L$), with which additional heat is removed so that the working fluid is at the same state as when it entered the pump 12, where it completes its cycle within the engine 10.

From the above, it should be appreciated that the thermodynamic cycle followed by the working fluid stream of the heat engine 10 is a Rankine cycle. It should also be appreciated that, as a turbine, the expansion device 24 is adapted to recover work and that other types of expansion devices could be used for this purpose. Some of the work recovered with the expansion device 24 can be used to drive either or both of the pumps 12 and 18.

FIG. 2 represents a particular but nonlimiting embodiment of the invention. As such, various modifications to the heat engine 10 are possible. For example, the regenerator 14 could be eliminated such that the pump 12 delivers the working fluid directly to the evaporator 16 and heat source 30, and the outlet of the separator 26 delivers the working fluid directly to the condenser 28 and heat sink 32. Other or additional modifications include eliminating the mixer 22 and instead directly injecting both the working fluid and flooding media injected into the expander 24. Furthermore, the liquid mixture containing the working fluid and flooding media could be passed through the regenerator 14 prior to being separated by the separator 26. It is also possible that a mixture of the flooding media and working fluid could flow through the entire cycle, eliminating the need for the mixer 22 and separator 26, as well as the pump 18 and heater 20 in the flooding media loop (though at a loss in cycle efficiency).

Other aspects and advantages of this invention will be further appreciated from a paper authored by Woodland et al. and entitled "Performance Benefits for Organic Rankine Cycles with Flooded Expansion and Internal Regeneration," International Refrigeration and Air Conditioning Conference at Purdue, 2462 (Jul. 12-15, 2010). The contents of this paper are incorporated herein by reference.

While the invention has been described in terms of a particular embodiment, it is apparent that other forms could be adopted by one skilled in the art. Therefore, the scope of the invention is to be limited only by the following claims.

The invention claimed is:

1. A heat engine system comprising:

a first pump operable to pump a first fluid from an inlet to an outlet thereof;

a regenerator having first and second inlets and first and second outlets, the first inlet being fluidically coupled to the outlet of the first pump and to the first outlet of the regenerator, the second inlet being fluidically coupled to the second outlet of the regenerator;

a heat source fluidically coupled to the first outlet of the regenerator and in thermal communication with the first fluid after exiting the regenerator through the first outlet thereof;

a mixer having an outlet and first and second inlets, the first inlet receiving the first fluid from the heat source;

a second pump operable to pump a second fluid from an inlet to an outlet thereof, the outlet of the second pump being fluidically coupled to the heat source to deliver the second fluid into thermal communication with the heat source, the outlet of the second pump being further fluidically coupled to the second inlet of the mixer so that the first and second fluids are mixed and brought into thermal communication by the mixer as a fluid mixture after the first and second fluids are in thermal communication with the heat source;

an expansion device having an inlet fluidically coupled to the outlet of the mixer, the expansion device further having an outlet through which the fluid mixture exits the expansion device;

a separator having an inlet and first and second outlets, the inlet of the separator receiving the fluid mixture from the outlet of the expansion device, the separator being operable to separate the first fluid from the second fluid and cause the first and second fluids to exit the separator through the first and second outlets, respectively, thereof, the first outlet of the separator being fluidically coupled with the second inlet of the regenerator and the second outlet of the separator being fluidically coupled with the inlet of the second pump; and a heat sink fluidically coupled to the second outlet of the regenerator and in thermal communication with the first fluid after exiting the regenerator through the second outlet thereof, the inlet of the first pump being fluidically coupled to the heat sink to receive the first fluid from the heat sink.

2. The heat engine system of claim 1, further comprising means for recovering work from the expansion device.

3. The heat engine system of claim 2, wherein the work-recovering means is connected for delivering power to at least one of the first and second pumps.

4. The heat engine system of claim 1, wherein the first fluid follows a Rankine thermodynamic cycle within the heat engine system.

5. The heat engine system of claim 1, wherein the second fluid has a higher heat capacity than the first fluid.

6. The heat engine system of claim 1, wherein the first fluid is a liquid refrigerant.

7. The heat engine system of claim 1, wherein the second fluid is chosen from the group consisting of water and oils.

8. The heat engine system of claim 1, wherein the heat source is a waste heat stream or a geothermal temperature source.

9. A method of using the heat engine system of claim 1 to extract thermal energy from the heat source, convert a first portion of the thermal energy to work using the expansion device, and reject a second portion of the thermal energy to the heat sink, the method comprising using the second fluid to inhibit a temperature drop of the first fluid within the expansion device.

10. A heat engine system comprising:

a first fluid comprising a liquid refrigerant;

a second fluid that remains in a subcooled liquid state within the heat engine system, the second fluid having a higher heat capacity than the first fluid;

a first pump operable to pump the first fluid from an inlet to an outlet thereof, the first liquid entering the inlet in a liquid state;

a regenerator having first and second inlets and first and second outlets, the first inlet being fluidically coupled to the outlet of the first pump and to the first outlet of the regenerator, the second inlet being fluidically coupled to the second outlet of the regenerator, wherein in sequence the first fluid enters the regenerator through the first inlet thereof and flows through the regenerator to exit the regenerator at the first outlet thereof and subsequently the first fluid enters the regenerator through the second inlet thereof and flows through the regenerator to exit the regenerator at the second first outlet thereof;

a heat source fluidically coupled to the first outlet of the regenerator and in thermal communication with the first fluid after exiting the regenerator through the first outlet thereof, the heat source operating to at least partially evaporate the first fluid;

a mixer having an outlet and first and second inlets, the first inlet receiving the first fluid from the heat source;

a second pump operable to pump the second fluid from an inlet to an outlet thereof, the outlet of the second pump being fluidically coupled to the heat source to deliver the second fluid into thermal communication with the heat source, the outlet of the second pump being further fluidically coupled to the second inlet of the mixer so that the first and second fluids are mixed and brought into thermal communication by the mixer as a fluid mixture after the first and second fluids are in thermal communication with the heat source;

an expansion device having an inlet fluidically coupled to the outlet of the mixer, the second fluid and the subcooled liquid state thereof inhibiting a temperature drop of the first fluid during expansion of the first fluid within the expansion device and prior to the first fluid entering the regenerator through the second inlet thereof, the expansion device further having an outlet through which the fluid mixture exits the expansion device;

a separator having an inlet and first and second outlets, the inlet of the separator receiving the fluid mixture from the outlet of the expansion device, the separator being operable to separate the first fluid from the second fluid and cause the first and second fluids to exit the separator through the first and second outlets, respectively, thereof, the first outlet of the separator being fluidically coupled with the second inlet of the regenerator and the second outlet of the separator being fluidically coupled with the inlet of the second pump; and a heat sink fluidically coupled to the second outlet of the regenerator and in thermal communication with the first fluid after exiting the regenerator through the second outlet thereof, the heat sink operating to return the first fluid to a liquid state, the inlet of the first pump being fluidically coupled to the heat sink to receive the first fluid from the heat sink.

11. The heat engine system of claim 10, further comprising means for recovering work from the expansion device.

12. The heat engine system of claim 11, wherein the work-recovering means is connected for delivering power to at least one of the first and second pumps.

13. The heat engine system of claim 10, wherein the first fluid follows a Rankine thermodynamic cycle within the heat engine system.

14. The heat engine system of claim 10, wherein the first fluid comprises at least one of R245fa, R717, R600a, n-Pentane and R245fa.

15. The heat engine system of claim 10, wherein the second fluid is chosen from the group consisting of water and oils.

16. The heat engine system of claim 10, wherein the heat source is a waste heat stream or a geothermal temperature source.

17. A method of using the heat engine system of claim 10 to extract thermal energy from the heat source, convert a first portion of the thermal energy to work using the expansion device, and reject a second portion of the thermal energy to the heat sink, the method comprising using the second fluid to inhibit the temperature drop of the first fluid during expansion of the first fluid within the expansion device and prior to the first fluid entering the regenerator through the second inlet thereof.

* * * * *